United States Patent [19]

Irvine et al.

[11] Patent Number: 4,548,393

[45] Date of Patent: Oct. 22, 1985

[54] INSERTER FEEDER DOCUMENT STOP

[75] Inventors: Robert Irvine, Riverside; John G. O'Brien, Darien; Harry E. Luperti, Wilton, all of Conn.

[73] Assignee: Pitney Bowes Inc., Stamford, Conn.

[21] Appl. No.: 569,415

[22] Filed: Jan. 9, 1984

[51] Int. Cl.[4] ..... B65H 43/00

[52] U.S. Cl. ..... 270/59; 271/121

[58] Field of Search ..... 270/59, 58; 250/560, 250/561, 548; 271/245, 246, 137, 9, 229; 198/530-531; 53/266 X

[56] References Cited

U.S. PATENT DOCUMENTS

| | | | |
|---|---|---|---|
| 2,708,760 | 5/1955 | Pearce | 270/59 X |
| 2,744,562 | 5/1956 | Rocca et al. | 270/59 |
| 3,325,163 | 6/1967 | Off et al. | 270/59 |
| 3,522,129 | 7/1970 | Crathern, III | 270/59 X |
| 3,692,302 | 9/1972 | Parups | 270/58 |
| 3,941,372 | 3/1976 | Matsuo | 271/104 X |
| 3,979,115 | 9/1976 | Bruckner et al. | 271/229 |
| 4,113,245 | 9/1978 | Colglazier et al. | 271/121 X |
| 4,169,341 | 10/1979 | Roetter et al. | 53/266 A X |
| 4,319,741 | 3/1982 | Okamoto | 271/121 X |
| 4,337,609 | 7/1982 | Foster et al. | 53/266 A X |
| 4,365,718 | 12/1982 | Howerton | 250/560 X |
| 4,429,985 | 2/1984 | Yokota | 250/248 |
| 4,458,890 | 7/1984 | Kawazu | 271/121 |
| 4,471,953 | 9/1984 | Reist et al. | 270/58 |

*Primary Examiner*—E. H. Eickholt

*Attorney, Agent, or Firm*—Lawrence E. Sklar; William D. Soltow, Jr.; Albert W. Scribner

[57] ABSTRACT

A stopping mechanism in an inserting machine having a feeder for feeding documents seriatim to a transport deck therebelow, the feeder being angled with respect to the deck. The stopping mechanism stops the documents at a predetermined position with respect to a previously collated package situated on a ramp located upstream of the deck and elevated with respect to the deck. The stopping mechanism comprises a pivotable paddle located downstream of the feeder substantially parallel to the direction of feed, a device for biasing the lower end of the paddle away from the transport deck to permit a collated package to pass therebelow without contacting the pivotable paddle, and a device for pivoting the lower end of the paddle downward adjacent the transport deck for a short period of time at an appropriate moment in order to stop the forward motion of a document exiting the feeder at a predetermined position on the transport deck.

5 Claims, 7 Drawing Figures

INSERTER FEEDER DOCUMENT STOP

BACKGROUND OF THE INVENTION

The instant invention relates to inserter feeders and more particularly to a device for stopping the documents exiting from the inserter feeders prior to their being collated into a package which is inserted into an envelope.

All large inserting machines contain a series of document feeders, from which a mixture of sizes and weights of paper are singly fed to the transport deck for collation into the package which is inserted into envelopes. The sizes and weights of the documents being fed can vary from a single thickness of paper 3"×5.5" to a booklet 9"×12" and 7/32" thick. When these documents reach the transport deck, all of the documents with various sizes and weights must be positioned with their trail edges located in reasonable proximity to the preceding raised ramp, in order to assure the sequence of each document being placed under the package being collated.

Many forms of stopping devices have been employed in order to properly position these documents and have been based on the principle of friction. A material having a high coefficient of friction is suspended above the area in which the documents are to be stopped. The normal force is typically generated by a spring, and for each type of document, the normal force and location of the stops must be adjusted. If the surface characteristics of the paper change in the course of a given run, then the stops have to be adjusted in the course of the run. The frictional force must be sufficient to stop the heaviest document, yet when a collation contains a single sheet as the topmost document, the frictional force cannot be so great as to peel back the top sheet as the collation passes beneath the stop.

The instant invention accordingly overcomes the problems discussed hereinabove in that it applies sufficient force to stop the heaviest document, yet does not interfere with the transporting of the collated package passing therebeneath.

SUMMARY OF THE INVENTION

The instant invention provides a stopping mechanism in an inserting machine having a feeder for feeding documents seriatim to a transport deck therebelow, the feeder being angled with respect to the deck. The stopping mechanism stops the documents at a predetermined position with respect to a previously collated package situated on a ramp located upstream of the deck and elevated with respect to the deck. The stopping mechanism comprises a pivotable paddle located downstream of the feeder substantially parallel to the direction of feed, means for biasing the lower end of the paddle away from the transport deck to permit a collated package to pass therebelow without contacting the pivotable paddle, and means for pivoting the lower end of the paddle downward adjacent the transport deck for a short period of time at an appropriate moment in order to stop the forward motion of a document exiting the feeder at a predetermined position on the transport deck.

DETAILED DESCRIPTION

Figure 1:
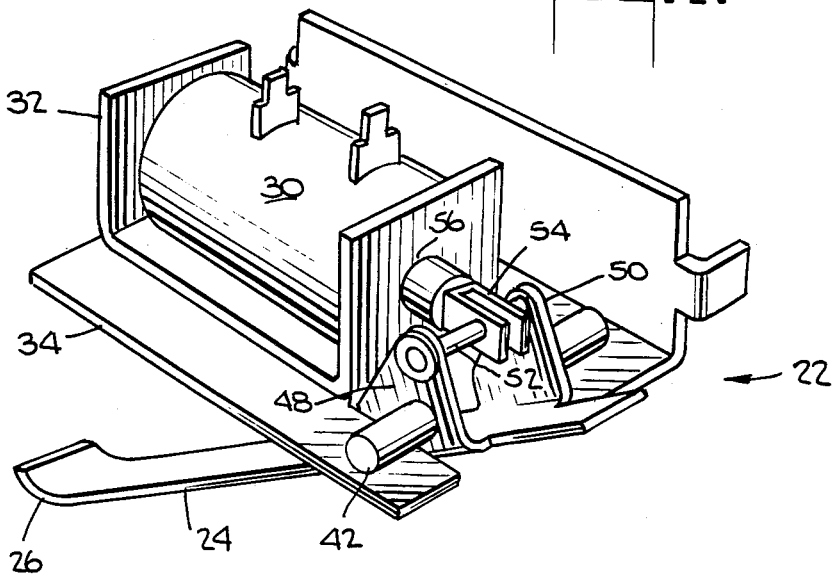
FIG. 1 is a perspective view of a stopping mechanism for an inserting machine feeder in accordance with the instant invention.
Figure 3:
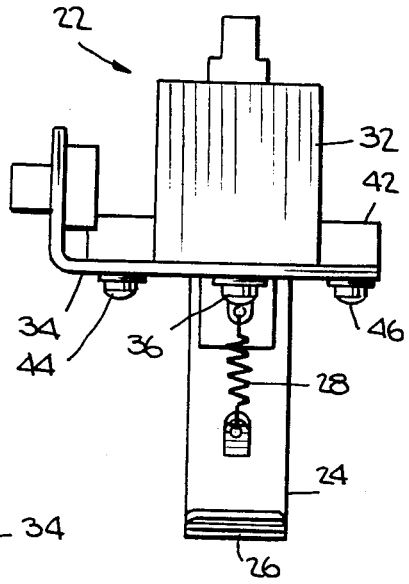
FIG. 3 is a front, elevational view of the stopping mechanism seen in FIG. 1.
Figure 2:
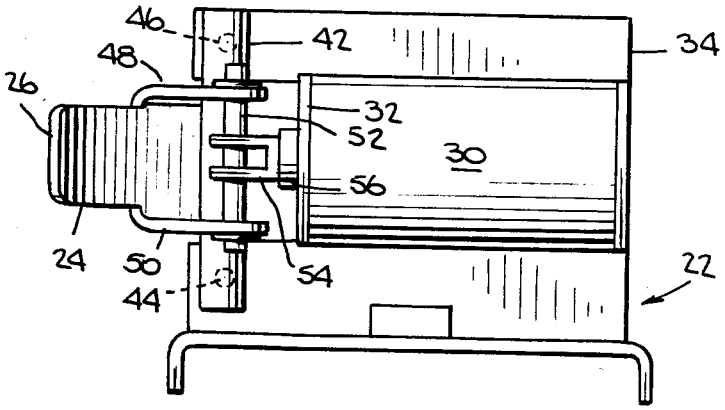
FIG. 2 is a top plan view of the stopping mechanism seen in FIG. 1.
Figure 4:
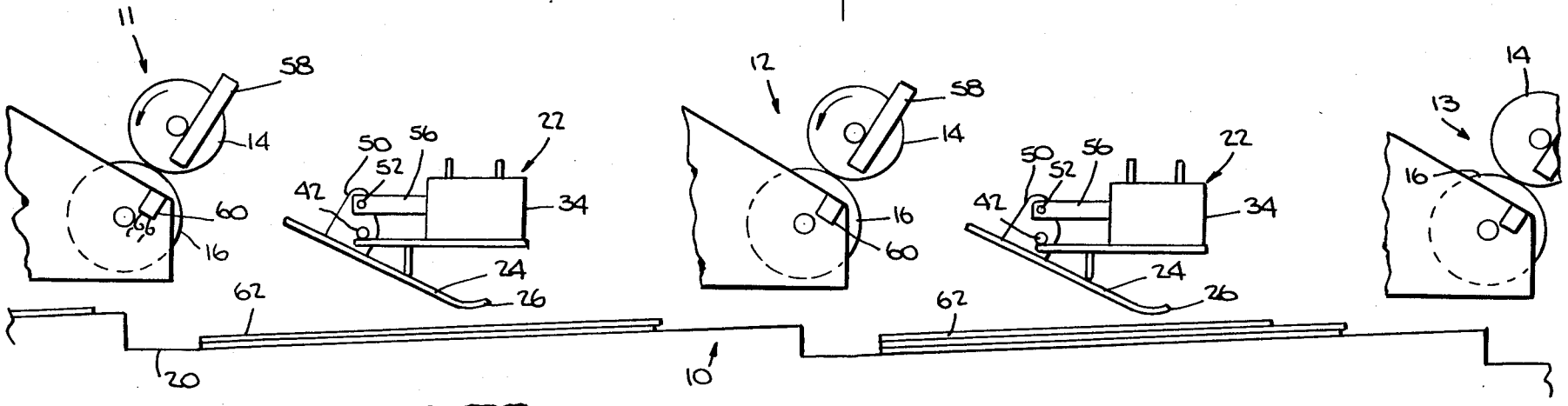
FIG. 4 is a schematic, side elevational view of an inserting machine feeder using the stopping mechanism according to the instant invention, and showing the stopping mechanism in its relaxed position.

In describing the instant invention, reference is made to the drawings, wherein there is seen an inserting machine (see FIGS. 4–7) generally designated 10 having a plurality of feeders generally designated 11, 12, and 13, each of which includes a pair of feeder exit rollers 14 and 16 for feeding a document 18 from a storage bin (not shown) located above the feeder exit rollers 14 and 16. Situated below the feeder 12 is a transport deck 20, which, as best seen in FIG. 4, steps down in the direction of transport (indicated by the arrows in FIGS. 4–7) for each of the succeeding feeders 11, 12 and 13.

Figure 6:
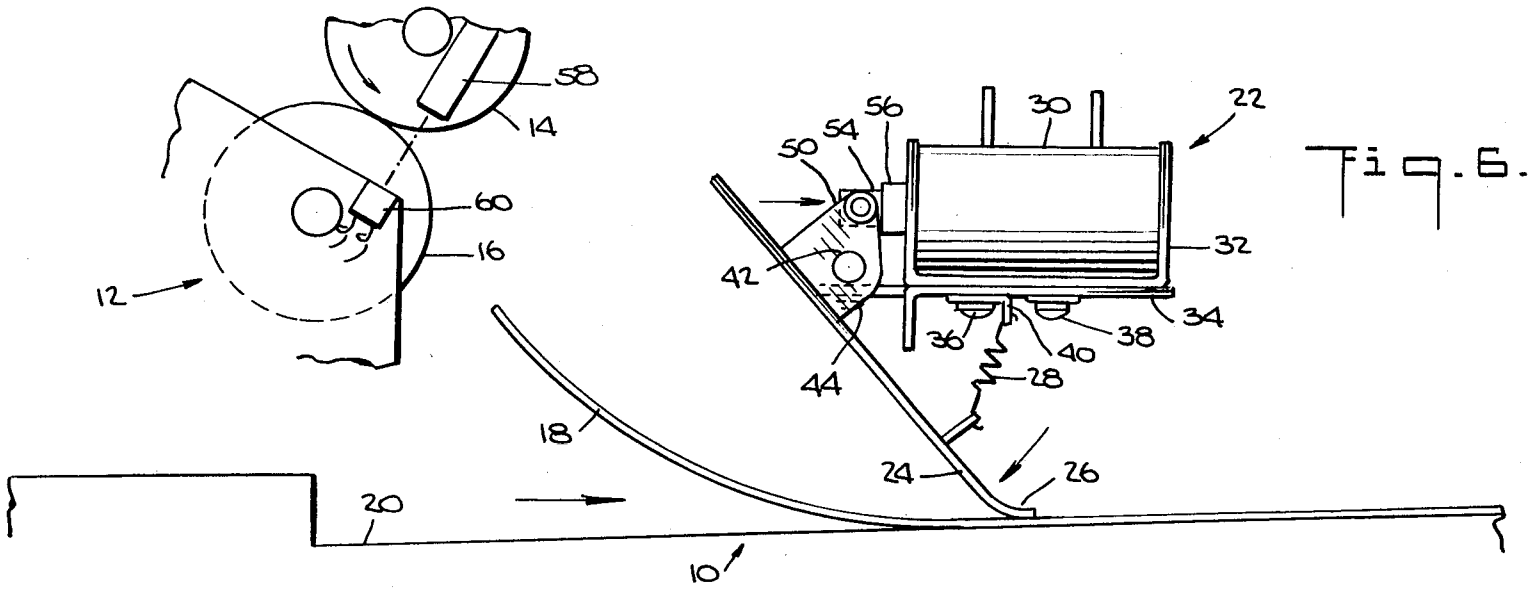
FIG. 6 is the same as FIG. 5 except the stopping mechanism has been pivoted downward to stop the forward motion of the document exiting the feeder.

A stopping mechanism generally designated 22 is located downstream of each of the feeder exit rollers 14 and 16 and includes a pivotable paddle 24 whose lower end 26 is biased away from the transport deck 20 by means of a coil spring 28. The pivotable paddle 24 is actuated so that its lower end 26 is located adjacent the transport deck 20, as seen in FIG. 6, by means of a solenoid 30 fixedly supported by a three-sided frame member 32 fixedly secured to a housing 34 by means of screws 36 and 38. The coil spring 28 is attached at one end to a flange 40 secured by the screws 36. The pivotable paddle 24 pivots about a shaft 42 fixedly secured to the housing 34 by means of screws 44 and 46. A pair of vertical flanges 48 and 50 extend upwardly from the sides of the paddle 24, and a pair of apertures in the lower portion of the flanges 48 and 50 rotatably receive the shaft 42. A second shaft 52 is mounted in a pair of apertures situated in the upper portion of the flanges 48 and 50 and receives a yoke 54 which extends from a plunger 56 from the solenoid 30. A photocell 58 and sensor 60 are located adjacent the feed rollers 14 and 16, and their operation is explained hereinbelow.

Figure 5:
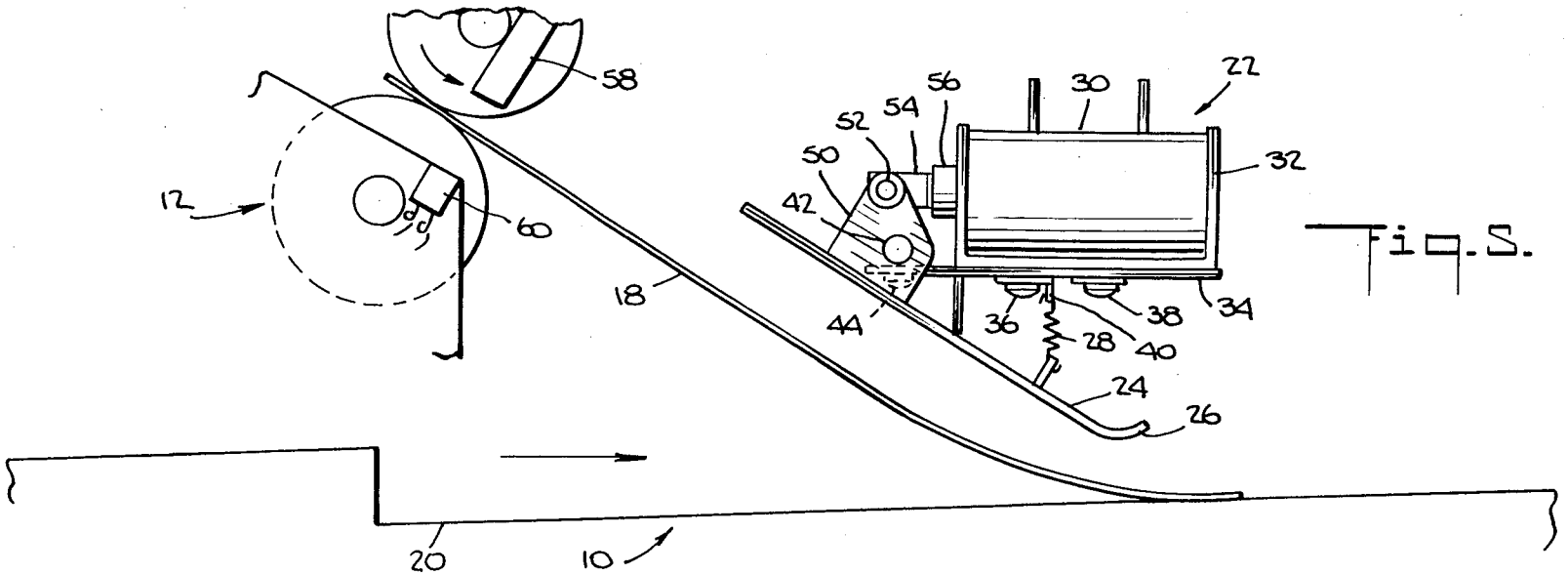
FIG. 5 is an enlarged, schematic, side elevational view of the stopping mechanism according to the instant invention showing a document exiting the feeder and passing underneath the stopping mechanism.

In describing the operation of the instant invention, reference is made to FIGS. 4–7, in which the area where a document 18 is to be stopped and the action required to do the stopping are depicted. At the correct instant in a cycle, a document 18 is fed from a feeder 12 down to the transport deck 20 as seen in FIG. 5. The position of the trail edge of the document 18 is critical to preventing the collation 62 being transported from behind colliding with the stopped document 18; the collation being transported 62 is intended to be deposited atop the stopped document 18. Since the position of the trail edge of the document 18 is critical, control of the entire process is through the trail edge.

Figure 7:
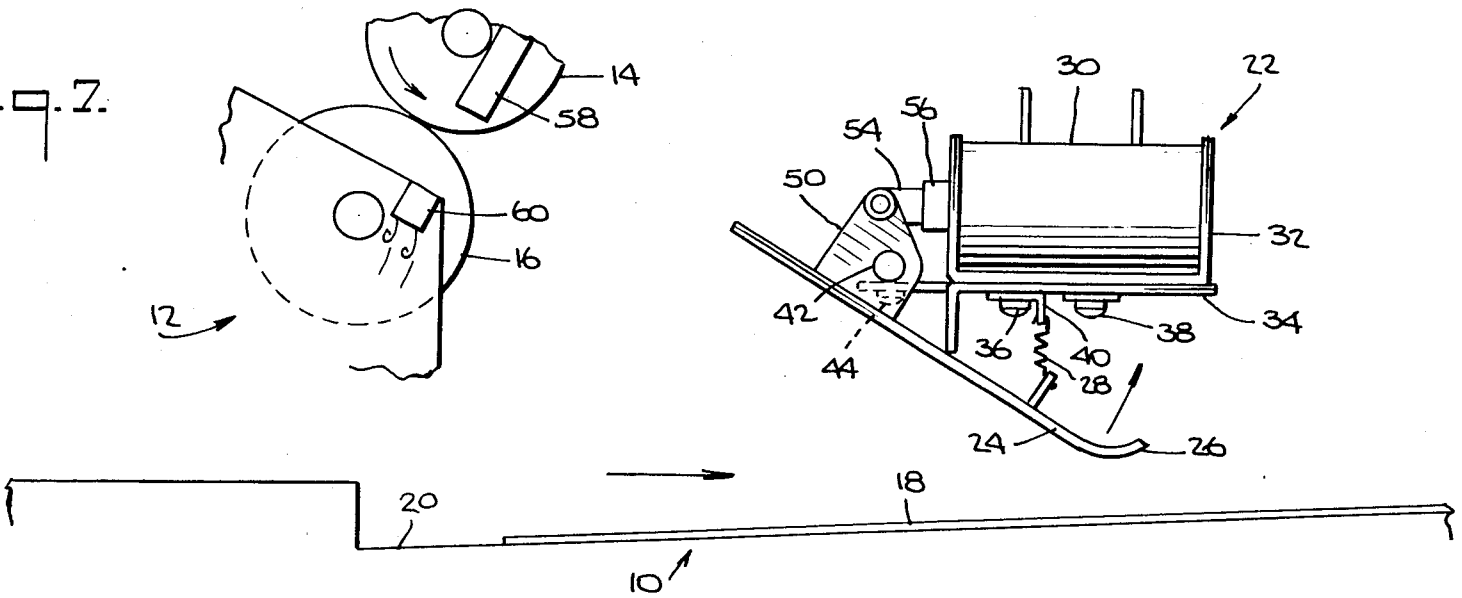
FIG. 7 is the same as FIG. 6 but it shows the stopping mechanism returned to its relaxed position and the document stopped at the predetermined position.

As the document 18 passes through the feeder exit rollers 14 and 16, it also passes through the photocell 58 and sensor 60. The lead edge of the document 18 reaches the transport deck 20, slides along the surface of the transport deck 20, and passes under the relaxed stopping mechanism 22 (see FIG. 5), i.e. the lower end 26 of the pivotable paddle 24 is biased away from the transport deck 20. When the trail edge of the document 18 exits the photocell 58, a signal is developed that activates an electronic circuit (not shown) which in turn energizes the solenoid 30. The plunger 56 is thereby caused to move to the right, which in turn moves the yoke 54 to the right, which in turn rotates the second shaft 52 and the flanges 48 and 50 in a clockwise direction about the shaft 42. The paddle 24 is thereby caused to rotate clockwise which effects a lowering of the lower end 26 of the paddle 24 against the upper surface of the moving document 18, as seen in FIG. 6. The electronic circuit then maintains the energization of the solenoid 30 for a short period of time (50 to 150 milliseconds) when the stopping mechanism 22 again returns to its relaxed position, as seen in FIG. 7. The collation being transported 62 can then be deposited atop the stopped document 18 and the new collation can pass underneath the relaxed stopping mechanism 22 without the possibility of the paddle 24 peeling back the top sheet of the collation passing therebeneath.

Although the present invention has been described in detail with respect to certain preferred embodiments thereof, it is apparent to those of skill in the art that variations and modifications in this detail may be effected without any departure from the spirit and scope of the present invention, as defined in the appended claims below.

What is claimed is:

1. In an inserting machine having a plurality of feeders arranged horizontally with respect to each other for feeding documents seriatim at an inclined angle to a single, horizontal, stepped transport deck therebelow, each of said feeders being angled with respect to said deck and having a pair of feeder exit rollers located above said transport deck, a stopping mechanism associated with each of said feeders for stopping said documents at a predetermined position with respect to a previously collated package situated on an upstream and elevated portion of said deck, said stopping mechanism comprising:

a pivotable paddle located above said transport deck and downstream of said feeder exit rollers for stopping said documents in the course of their passing below said paddle, said paddle being substantially parallel to the inclined direction of feed;

means for biasing the lower end of said paddle away from said transport deck therebelow to permit a collated package to pass therebelow without contacting said pivotable paddle; and means for pivoting the lower end of said paddle downward adjacent said transport deck therebelow for a short period of time at an appropriate moment in order to stop the forward motion of a document exiting the feeder exit rollers at a predetermined position on the transport deck.

2. The stopping mechanism of claim 1, wherein the biasing means comprises a coil spring.

3. The stopping mechanism of claim 1, wherein the pivoting means comprises a solenoid.

4. The stopping mechanism of claim 3, wherein the short period of time is between about 50 and 150 milliseconds.

5. The stopping mechanism of claim 3, wherein the stopping mechanism additionally comprises a photocell and sensor for detecting the trail edge of the document as it exits the feeder and developing a signal for activating said solenoid.

* * * * *